US009919405B2

(12) United States Patent
Nguyen et al.

(10) Patent No.: US 9,919,405 B2
(45) Date of Patent: Mar. 20, 2018

(54) AIR BLAST BLOWDOWN SILENCER SYSTEM FOR BLAST POT

(71) Applicants: Phuong Taylor Nguyen, Richmond, TX (US); Antony Rodriguez, Rosenberg, TX (US)

(72) Inventors: Phuong Taylor Nguyen, Richmond, TX (US); Antony Rodriguez, Rosenberg, TX (US)

( * ) Notice: Subject to any disclaimer, the term of this patent is extended or adjusted under 35 U.S.C. 154(b) by 0 days.

(21) Appl. No.: 14/177,222

(22) Filed: Feb. 11, 2014

(65) Prior Publication Data

US 2016/0361796 A1 Dec. 15, 2016

(51) Int. Cl.

| | |
|---|---|
| ***B24C 9/00*** | (2006.01) |
| ***G10K 11/16*** | (2006.01) |
| ***G10K 11/28*** | (2006.01) |

(52) U.S. Cl.

CPC ..... *B24C 9/00* (2013.01); *G10K 11/161* (2013.01); *G10K 11/28* (2013.01)

(58) Field of Classification Search

CPC ..... B24C 9/00; B24C 9/0006; G10K 11/161
USPC ..... 181/230, 231; 451/75, 101
See application file for complete search history.

(56) References Cited

U.S. PATENT DOCUMENTS

| | | | | |
|---|---|---|---|---|
| 4,026,072 A * | 5/1977 | Dremann | B24C 9/006 | 181/231 |
| 5,433,653 A * | 7/1995 | Friess | B24C 1/003 | 451/100 |
| 8,708,779 B2 * | 4/2014 | Nguyen | B24C 9/00 | 181/230 |

* cited by examiner

*Primary Examiner* — Jeremy Luks

(57) ABSTRACT

A conditioning device complements a silencer with higher sound attenuation and also allows the silencer to better withstand abrasion of grit entrained exhaust air flow from decompressing an airblast pot. The device is configured to achieve four functions. First is to control and direct the exhaust air flow. Second is to absorb the impact of the entrained particles. Third is to diffuse and slow down the exhaust air velocity. Fourth is to direct and deflect the sound waves to the sound absorption surfaces located downstream.

4 Claims, 3 Drawing Sheets

AIR BLAST BLOWDOWN SILENCER SYSTEM FOR BLAST POT

BACKGROUND OF THE INVENTION

Field of the Invention

The subject invention is generally directed to exhaust systems for blowdown exhaust on blast pots and is specifically directed to a silencer for the exhaust system.

Discussion of the Prior Art

Blast pot systems are well known in the abrasive blasting industry wherein particulate abrasives are released under pressure against various surfaces in surface preparation applications. It has long been important to depressurize the pressure vessel or blast pot during times of non-use, for periodically replenishing the abrasive material in the vessel or for routine maintenance. The depressurization of blast pots involves first shutting down the system pressure and then releasing the pressure in the vessel through a port commonly referred to as a blowdown port. Typically, this generates a high volume of air and creates with it a loud noise level, sometimes as high as 130 dB, which is typical during the initial blowdown procedure. While it is not necessary to reduce this noise level, it is desirable to do so. In addition, particularly when the blast pot is full of particulate abrasive matter during blowdown, the exhausted air contains abrasive particles which can be destructive.

It is, therefore, desirable to reduce the level of noise and contain the destructive flow of particulate matter during blowdown.

Several systems have been designed to provide noise control. One design utilizes a small cylindrical porous element with external wire mesh reinforcement. All of which are encased in a metal housing with two slotted exhaust ports located 180 degrees from each other. The element can be replaced or cleaned by removing a pipe plug at the end. While this design does suppress noise, the porous element can accumulate dust and "clog". In addition, the design is such that the abrasive particles that are entrained in the airstream will rebound off the pipe plug and destructively strike the element. In addition, because of the flow of the destructive particles this design inherently has a short life span in use. In order to prolong life, daily cleaning is require, which is not realistic in the working environment. As a result, end users will usually remove the system once it is damaged. A further drawback to this system is that the slotted port on the side of the housing will direct exhaust air and fugitive particles horizontally. This could blow dust and particles onto anyone near the exhaust.

In another system, the airflow is exhausted through a large porous (small pores) element encased by perforated metal. This design offers adequate noise suppression with good airflow. However, the design can trap dust and quickly become more restrictive.

Other examples offer the similar styles that place a porous type element or mesh in the direct or rebound path of the exhaust compressed air near the expansion point.

One such system is disclosed in my copending application Ser. No. 13/021,256, entitled: "Air Blast Blowdown Silencer System for Blast Pot", entitled filed on Feb. 4, 2011. The blowdown system there disclosed includes an initial restrictor in communication with a blast pot vessel for controlling the flow of pressurized air from the vessel into a first expansion chamber which is in communication with a reducer. The outlet of the reducer introduced into a muffler system which includes an exhaust path and a deflector for absorbing and or deflecting abrasive particles which may be evacuated from the blast pot vessel during blowdown.

Decompressing or "blowing down" a blast pot without a muffler or silencer could create noise levels in excess of 130 dB. In addition, the grit particles that are often mixed and entrained within the exhaust flow are traveling at a high velocity. These particles will abrade any obstruction of the exhaust airstream. Prior art would use mufflers that direct all or most of the exhaust flow through porous membranes. While this does reduce the exhaust noise level, the membranes would eventually clog as they accumulate dust. The clogged membranes restrict air flow and progressively increase decompression time, creating a potentially hazardous situation.

In addition, these porous elements were not capable of withstanding impact and would wear quickly. The aforementioned patent application utilizes an expansion chamber and sound absorptive material to reduce the noise level. While this sufficiently mitigated the abrasion of exhaust air from the device, it did not address the abrasion on the sound absorptive components within.

SUMMARY OF THE INVENTION

The subject invention is directed to a conditioning device to complement a silencer with higher sound attenuation and to allow the silencer to better withstand abrasion of grit entrained exhaust air flow from decompressing an airblast pot. The device is configured to achieve four functions. First is to control and direct the exhaust air flow. Second is to absorb the impact of the entrained particles. Third is to diffuse and slow down the exhaust air velocity. Fourth is to direct and deflect the sound waves to the sound absorption surfaces located downstream. In tests, this design improved the sound attenuation of the prior art design by 12 dBA (from 123 dBA to 111 dBA) with less sound absorption area The device of the subject invention will condition the sound for optimum sound absorption, condition the abrasion by striking the particles against wear resistant surfaces thus reducing its inertia, and condition the air flow by slowing the exhaust air velocity. This will allow standard absorptive silencers placed downstream to absorb more sound and wear slower, thus lasting longer.

A diffuser sound ring or baffle absorbs sound. This is attached to the ID of the diffuser housing and absorbs sound from the exhaust slots.

A wear cap is positioned in the center of the diffuser housing and houses a wear insert assembly. The wear insert assembly consists of two parts: a removable conical wear insert that is made of a wear resistant material, and an insert housing or cap. The insert can be changed quickly but does not get blown out of position. The material of this insert could vary based upon the type of abrasives. One suitable material is solid tungsten carbide. The cap is constructed of a wear resistant urethane or similar material and is inserted through the internal diffuser or baffle.

The internal baffle is also constructed of wear resistant material, for example an ultra high molecular weight polyethelene (UHMWPE). It is designed to disperse the air flow and sound through many small ports. The sum of the flow area of the many ports is many times greater the flow area of the restrictor or blowdown hose. The smaller ports disperse the exhaust towards the outside and increase how sound waves are absorbed by the absorptive material downstream. Also, the increased exhaust flow area of the baffle significantly reduces the air velocity which also reduces the wear on the components downstream.

A deflector tip or cone is part of or is fastened to the wear insert cap and is installed on the other side of the baffle. Effectively the baffle is sandwiched between the wear insert cap and the deflector tip. The deflector tip will deflect unabsorbed sound wave that strike its surface and reflect it towards the internal sound absorption cylinder located downstream. The shape of the deflector is drawn a spherical tip but other geometries, such as a serrated cone, have also been found to be useful.

DETAILED DESCRIPTION

Figure 1:
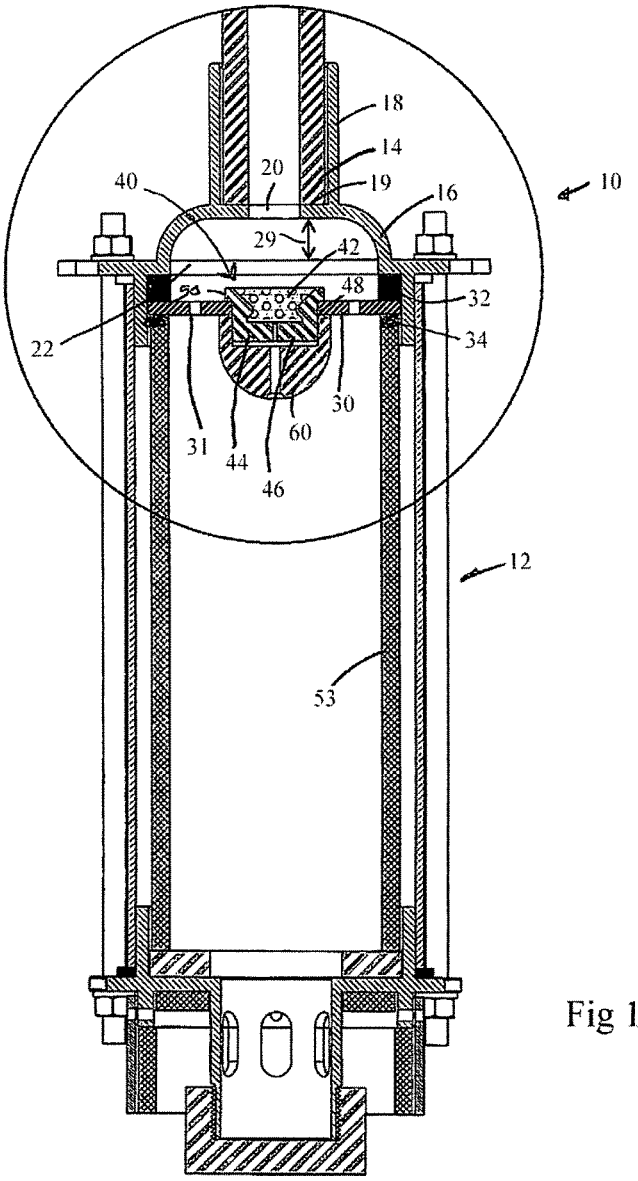
FIG. 1 is a cross-sectional view of the silencer system of the subject invention installed in a typical muffler assembly and connected to a blowdown hose.
Figure 2:
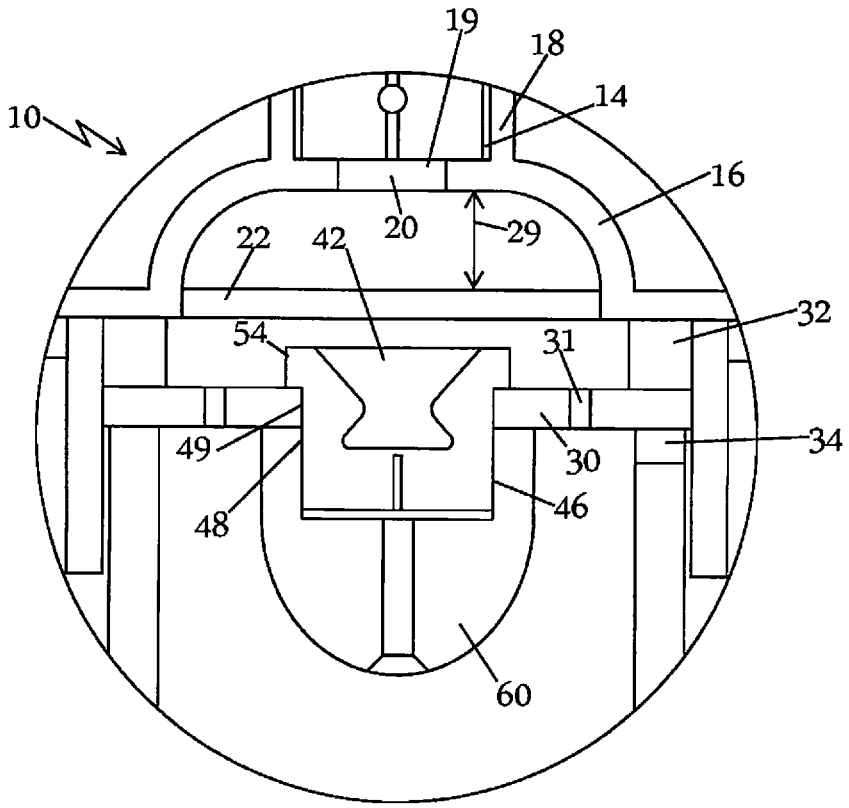
FIG. 2 is a partial view looking in the same direction as FIG. 1 and enlarged to better depict the components of the silencer system.
Figure 3:
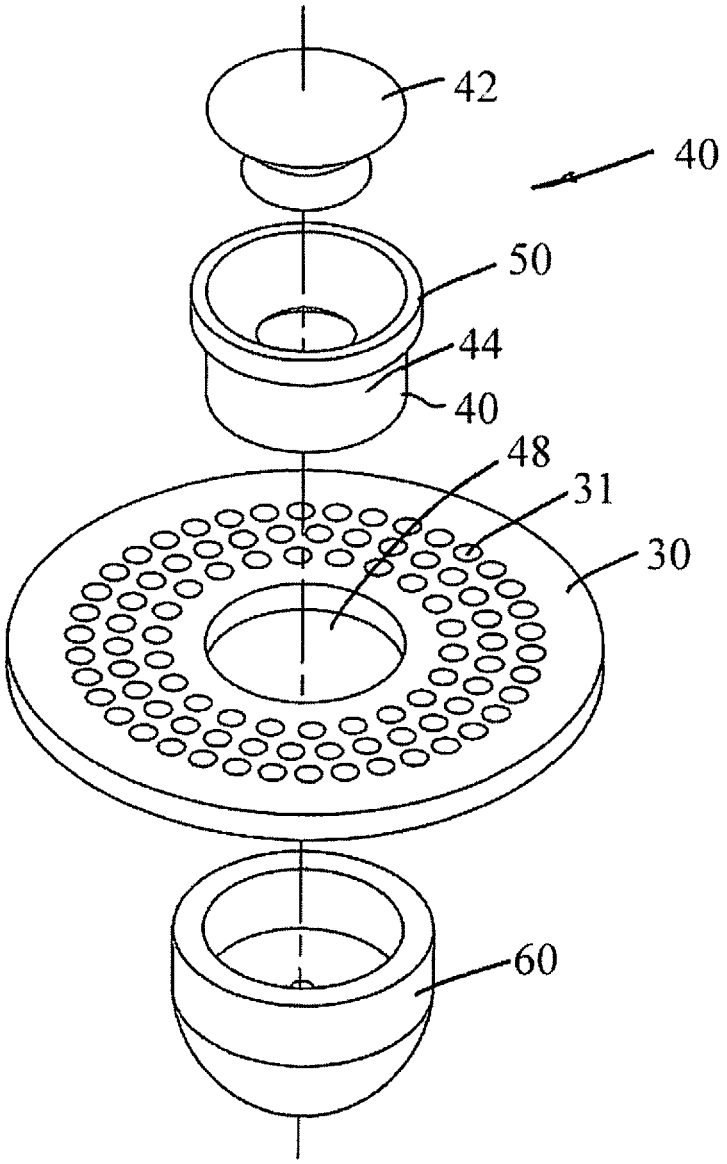
FIG. 3 is an exploded perspective view of the components of the silencer system.

As shown in FIG. 1, the silencer system 10 of the subject invention is adapted to be mounted on a muffler assembly 12 and connected to the exhaust end 19 of a blowdown hose 14. The blowdown hose functions as a port that restricts and directs the exhaust flow into the internal muffler volume, in the manner shown and described in my aforementioned patent application.

In the subject invention, the blowdown hose is connected to a ported plate 16 with a port assembly ring 18 for securing and positioning the blowdown hose in the inlet port 20 which serves as the inlet to the muffler. In the preferred embodiment the restrictor exit (or exhaust end of the blowdown hose) is distanced from the from the upper end 22 of the muffler and from the diffuser plate or baffle 30 of the subject invention. The baffle plate 30 is a ring with multiple holes or openings 31. The combined open area of the holes 31 is larger than the cross-sectional opening of the blowdown hose 14.

Gaskets 32 and 34 are placed above and below the baffle 30. These are made of a soft elastic material. The gaskets seal the upper gaps of the muffler interior to prevent sound from escaping. They also provide elastic support for the baffle so that it can convert kinetic energy from the exhausted particles to deflecting or deforming the gaskets. This has the effect of deadening the rebound of any particles within the exhaust air stream by converting the kinetic energy of the particles into energy compressing the gaskets 32 and 34.

The wear insert assembly 40 comprises a wear element 42 and an insert cap 44. The removable wear element is made of a wear resistant material. In the embodiment illustrated the element is of a substantially conical shape. The element shape allows it to be changed quickly but not get blown out of position by the exhaust. The material of the wear element can vary based upon the type of abrasives. One suitable material is solid tungsten carbide. A fine powder of the most aggressive blast abrasive, aluminum oxide, bound with a small percentage of epoxy or similar binder has also been used and in some applications is just as effective and less expensive. Other suitable materials may include gum rubber and varying hardness of polyurethane. Since the insert wear element is small, the cost for replacement is not prohibitive. As illustrated, the strike surface on the conical insert is flat, but other configurations may apply as well.

The insert cap 44 houses the insert wear element 42. One suitable material for the cap is wear resistant urethane, while others may be used based on application. In the illustrated embodiment the cap has a cylindrical base 46 adapted to be received in the receptive hole 48 in the baffle plate 30. The upper end of the cap includes a flange 50 adapted for seating and positioning the cap 44 in the baffle ring 30. The cap includes a cavity 52 for housing the wear element insert 42.

The internal baffle 30 is also constructed of wear resistant material, such as, by way of example, UHMWPE. It is designed to disperse the air flow and sound through the many small holes or ports 31. The sum of the flow area of the many ports is many times greater the flow area of the restrictor or blowdown hose 14. The smaller ports disperse the exhaust towards the outside and increase the absorption of sound waves by the absorptive material 53 downstream in the muffler body 12. Also, the increased exhaust flow area of the baffle significantly reduces the air velocity, which also reduces the wear on the components downstream. Sound absorptive materials inherently wear quickly so components made of this material will benefit.

The deflector tip or cone 60 is fastened to the wear insert cap 44 and is installed on the other side of the baffle 30. Effectively the baffle is sandwiched between the flange 50 of the wear insert cap 44 and the deflector tip 60. The deflector tip will deflect unabsorbed sound wave that strike its surface and deflect it towards the internal sound absorption material 52 in the muffler cylinder 12. The shape of the deflector as shown is a spherical tip, but other geometries, such as a serrated cone may be used depending on application. It is also possible to mold the wear insert cap, baffle and deflector into one component and only leave the wear insert element as a replaceable wear item.

While certain objects and features of the invention have been disclosed in detail herein, it should be understood that the invention encompasses all modifications and enhancements within the scope and spirit of the following claims.

What is claimed is:

1. A silencer for an exhaust release system of a blast pot for receiving and directing an exhaust flow and debris and media contained in the exhaust flow from the blast pot and for collecting debris and media contained in the exhaust flow, the release system positioned to receive the exhaust, debris and media and an outlet for releasing the exhaust, the silencer adapted to be placed intermediately of the exhaust outlet and a muffler for reducing any noise generated by the exhaust flow, the silencer comprising:

a. A generally cylindrical baffle having an outer diameter and an inner diameter, with a central opening through which all of the exhaust flow passes, including all debris and media in said exhaust flow positioned in communication with the exhaust outlet and through which all of the exhaust flow passes from the exhaust flow outlet and the muffler;

b. the muffler positioned to receive all of the exhaust flow passing through the baffle;

c. A receptacle placed in the center of the baffle and in communication with the muffler;

d. A disposable wear element held in the receptacle and adapted to intercept a major portion of the debris and media which may be contained in the exhaust flow; and e. Shock absorbing seals between the baffle and the muffler, permitting the baffle to vibrate during operation, further breaking down the kinetic energy of the exhaust flow.

2. The silencer of claim 1, further including a deflector positioned under the baffle to deflect reflected sound waves from the muffler [sound absorptive surface] back toward the muffler and the baffle.

3. The silencer of claim 1, wherein the baffle includes a plurality of through holes, the cross-sectional area of which exceeds the cross-sectional area of the exhaust outlet.

4. The silencer of claim 1, the baffle having an upper surface in communication with an exhaust port of the blast pot and a lower surface in communication with the muffler, wherein there is a predetermined gap between the exhaust outlet of the blast pot and the upper surface of the baffle.

* * * * *